US007086829B2

(12) United States Patent
Fuller et al.

(10) Patent No.: US 7,086,829 B2
(45) Date of Patent: Aug. 8, 2006

(54) FILM COOLING FOR THE TRAILING EDGE OF A STEAM COOLED NOZZLE

(75) Inventors: Jason Fuller, Simpsonville, SC (US); Gary Itzel, Simpsonville, SC (US); Cathy Chiurato, Simpsonville, SC (US); Matthew Findlay, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 9 days.

(21) Appl. No.: 10/771,195

(22) Filed: Feb. 3, 2004

(65) Prior Publication Data

US 2005/0169746 A1 Aug. 4, 2005

(51) Int. Cl.
*F04D 29/58* (2006.01)
*F01D 5/18* (2006.01)

(52) U.S. Cl. ..... 415/115; 416/90 R; 416/97 A

(58) Field of Classification Search ..... 415/115, 415/116, 914; 416/90 R, 92, 95, 96 R, 97 R, 416/97 A, 96 A
See application file for complete search history.

(56) References Cited

U.S. PATENT DOCUMENTS 3,560,107 A * 2/1971 Helms ..... 416/90 R
5,591,002 A 1/1997 Cunha et al.
6,325,593 B1 * 12/2001 Darkins et al. ..... 415/115
6,398,486 B1 6/2002 Storey et al.
6,402,466 B1 6/2002 Burdgick et al.
6,435,814 B1 8/2002 Yu et al.
6,506,013 B1 1/2003 Burdgick et al.
6,517,312 B1 2/2003 Jones et al.
6,527,274 B1 3/2003 Heron et al.
6,553,665 B1 4/2003 Gunn et al.
6,561,757 B1 5/2003 Burdgick et al.
6,572,335 B1 * 6/2003 Kuwabara et al. ..... 416/97 R
6,583,526 B1 6/2003 Griffith et al.

* cited by examiner

*Primary Examiner*—Edward K. Look
*Assistant Examiner*—Dwayne J White
(74) *Attorney, Agent, or Firm*—Polster, Lieder, Woodruff & Lucchesi, L.C.

(57) ABSTRACT

A nozzle assembly (10) for a turbine engine includes an inner band (16) and an outer band (14) spaced apart from each other. An airfoil (12) installed between the bands has a leading edge (18) and a trailing edge (20). The airfoil has cavities formed in it for fluid flow through the nozzle assembly. A plurality of film cooling holes (1A–6H) are formed in a sidewall of the airfoil on a concave side of the assembly, and a plurality of film cooling holes (1J–1R) are formed in a sidewall of the nozzle on a convex side thereof. The holes are formed on each side of the airfoil, adjacent the trailing edge of the nozzle, in a plurality of rows of holes including at least a forward row (C, J), an aft row (A, L), and an intermediate row (B, K). The spacing between the intermediate row and aft row is substantially closer than the spacing between the forward row and the intermediate row.

4 Claims, 6 Drawing Sheets

FILM COOLING FOR THE TRAILING EDGE OF A STEAM COOLED NOZZLE

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to the cooling of an airfoil comprising a portion of a stator vane or nozzle of the first stage of a gas turbine engine; and more particularly, to the hole pattern formation in the airfoil for thin film cooling of a trailing edge of the airfoil.

In the construction of gas turbine engines, an annular array of turbine segments is provided to form a turbine stage. Generally, the turbine stage is defined by outer and inner annular bands spaced apart from each other with a plurality of vanes or airfoils extending between the bands and circumferentially spaced from one other. This construction, in turn, defines a path for a working fluid flowing through the turbine. In a gas turbine engine, this is a hot gas. As will be appreciated by those skilled in the art, the most extreme adverse operating conditions are generally encountered at the first stage of the turbine. That is because this stage is immediately downstream of the engine's combustion chamber and components comprising this stage must therefore withstand high thermal loads. As is known in the art, cooling systems for this engine stage utilize thin film cooling techniques to insure so adequate cooling is provided. Thin film cooling is accomplished by discharging air through orifices formed in portions of the nozzle. The discharged air then forms a protective thin film boundary layer between the hot stream of gases flowing through the first stage of the turbine and the surface of the nozzle.

Various problems with thin film cooling systems have been encountered and solutions to these problems have been addressed in U.S. Pat. Nos. 6,583,526, 6,561,757, 6,553,665, 6,527,274, 6,517,312, 6,506,013, 6,435,814, 6,402,466, 6,398,486, and 5,591,002, all of which are assigned to the same assignee as the present application.

The present invention is directed to an advanced film-cooling configuration for cooling the trailing edge of a nozzle used in the first stage of an advanced design gas turbine engine. The nozzle is a steam cooled component which operates at firing temperatures which require cooling of the airfoil to extend the low cycle fatigue (LCF), oxidation, and creep life of the component. While steam adequately cools the majority of the nozzle, it is not feasible for use in cooling the trailing edge of the nozzle. Rather, this requires a novel and advanced thin film cooling configuration in order for the trailing edge to not rapidly deteriorate once the turbine is in service which would require costly servicing or replacement of the nozzle and unacceptable down-time when the turbine is out of service.

BRIEF SUMMARY OF THE INVENTION

Briefly stated, the present invention is directed to thin film cooling of the trailing edge of a nozzle for the first stage of a gas turbine engine. Cooling is affected by use of a plurality of rows of film cooling holes located adjacent the trailing edge of the nozzle, on both the concave side and convex side of the nozzle. In particular, three rows of film cooling holes are formed in the sidewalls of the nozzle on the respective concave and convex sides thereof. A first and forward row of holes extends generally longitudinally of the nozzle and comprises holes of varying sizes and angles formed at predetermined locations on the nozzle. Second and third rows of holes also extend generally longitudinally of the nozzle and also comprise holes of varying sizes and angles formed at predetermined locations on the nozzle. The second row of holes comprises a middle row of holes and the third row an aft row. Holes comprising the second row are spaced a substantial distance from those comprising the first row. However, the second and third row of holes are formed relatively close together with the holes comprising the second row being staggered in location with respect to those comprising the third row. By placing the middle and aft rows of holes closer together, and staggering the hole arrangement in these two rows, an effective film flow is achieved which cools the trailing edge of the nozzle thereby to minimize cooling flow, optimize performance of the turbine engine, reduce NOx produced by the engine, prolong the service life of the nozzle and reduce service and repair costs.

Two embodiments of the invention are shown with the thin film cooling arrangement of the first embodiment including substantially more holes in each row than occurs in the second embodiment.

The foregoing and other objects, features, and advantages of the invention will be in part apparent and in part pointed out hereinafter.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1A:
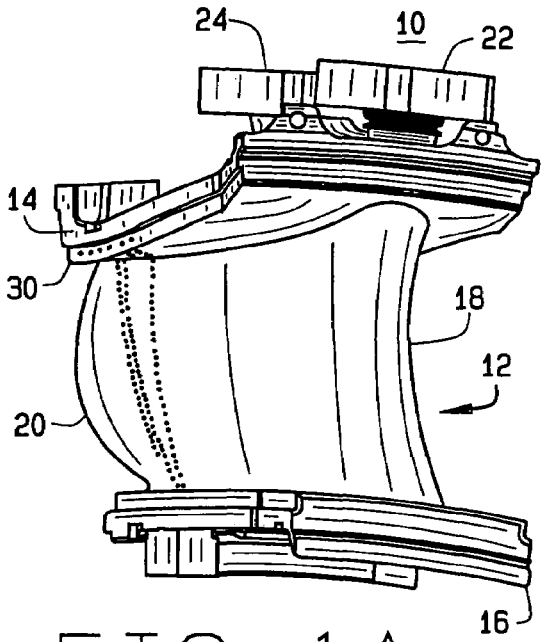
FIG. 1A is an orthographic view of the concave side of a first embodiment of a first stage nozzle for a gas turbine.
Figure 1B:
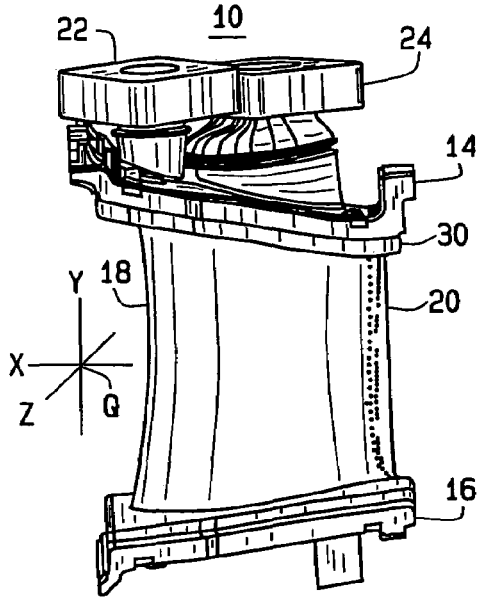
FIG. 1B is an orthographic view of the nozzle from the convex side.

Referring to the drawings, the present invention is directed to thin film cooling for a first stage nozzle assembly, indicated generally 10 in FIGS. 1A and 1B, of a gas turbine engine. While not shown in the drawings, those skilled in the art will appreciate that nozzle assembly 10 is comprised of a plurality of circumferentially arranged vanes or airfoils indicated generally 12, the respective segments being connected to one another to form an annular array which defines a path for hot gasses passing through the first stage.

Figure 5:
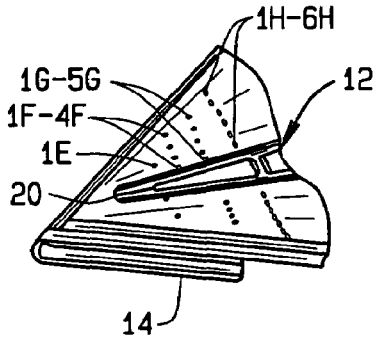
FIG. 5 is a view of the flow path side of the outer band at the trailing edge further illustrating the film hole pattern on the concave side of the airfoil.
Figure 2:
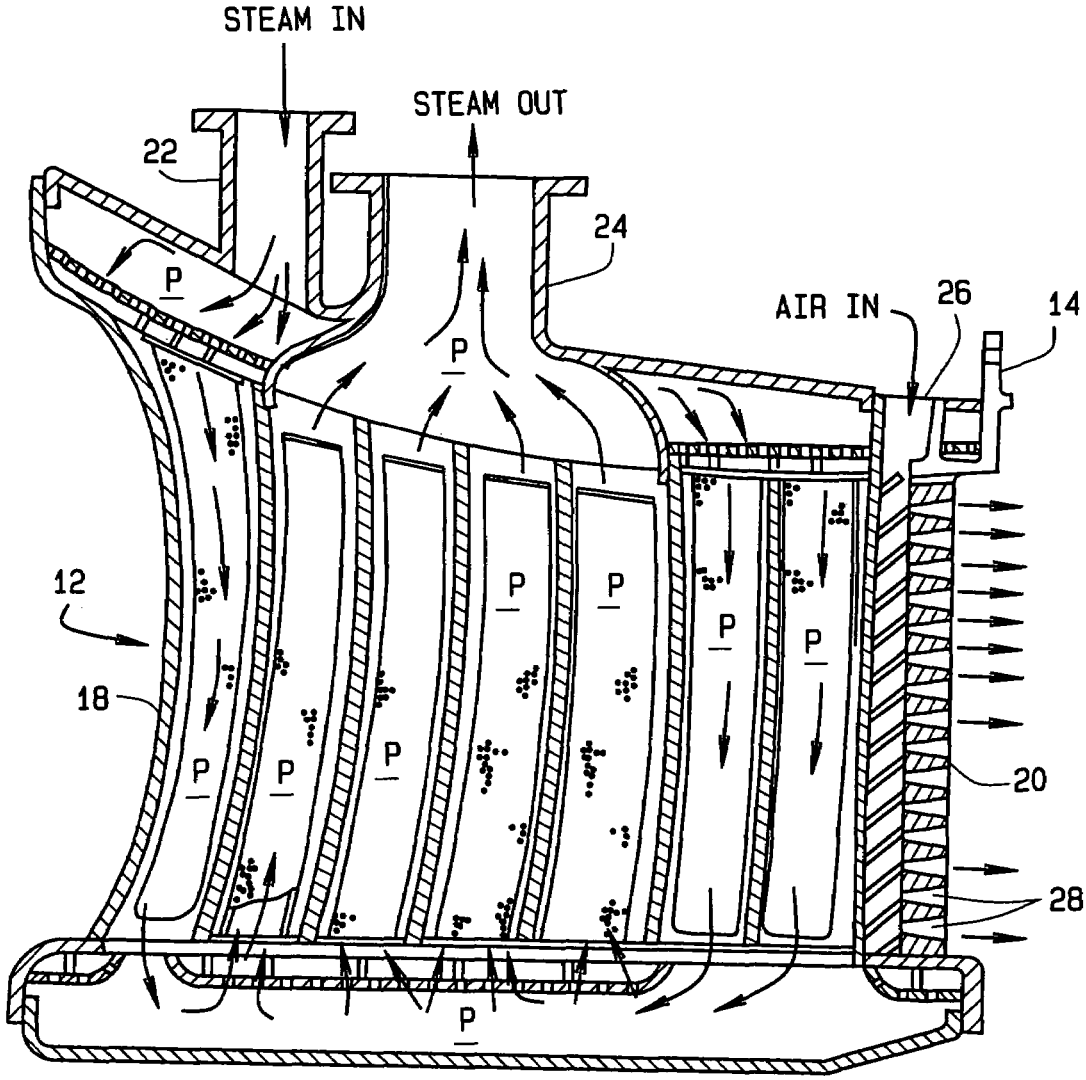
FIG. 2 is a sectional view of an airfoil portion of the nozzle illustrating steam and air flow paths through the air foil.
Figure 3:
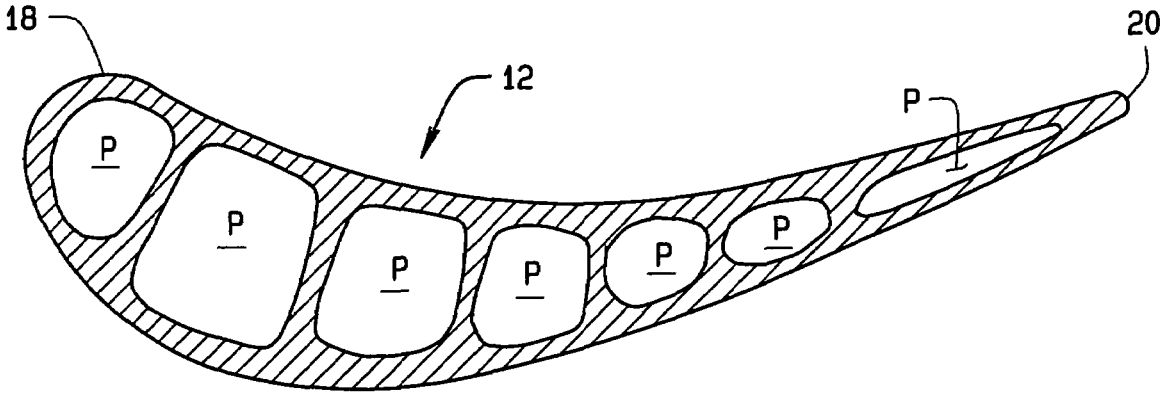
FIG. 3 is a sectional view of the airfoil.
Figure 7:
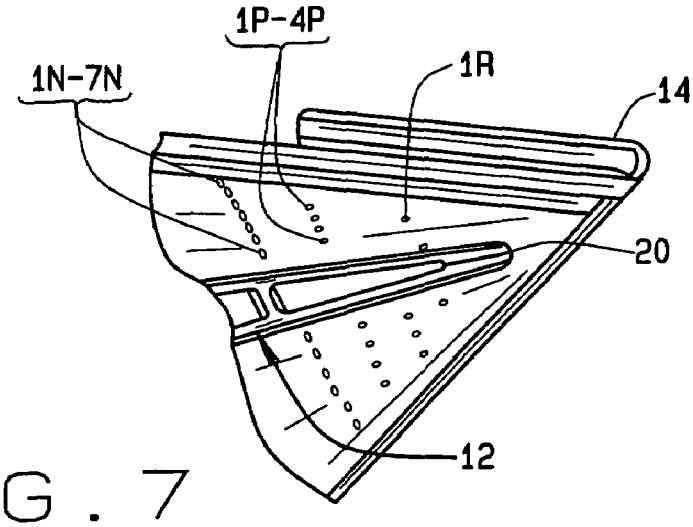
Figure 8A:
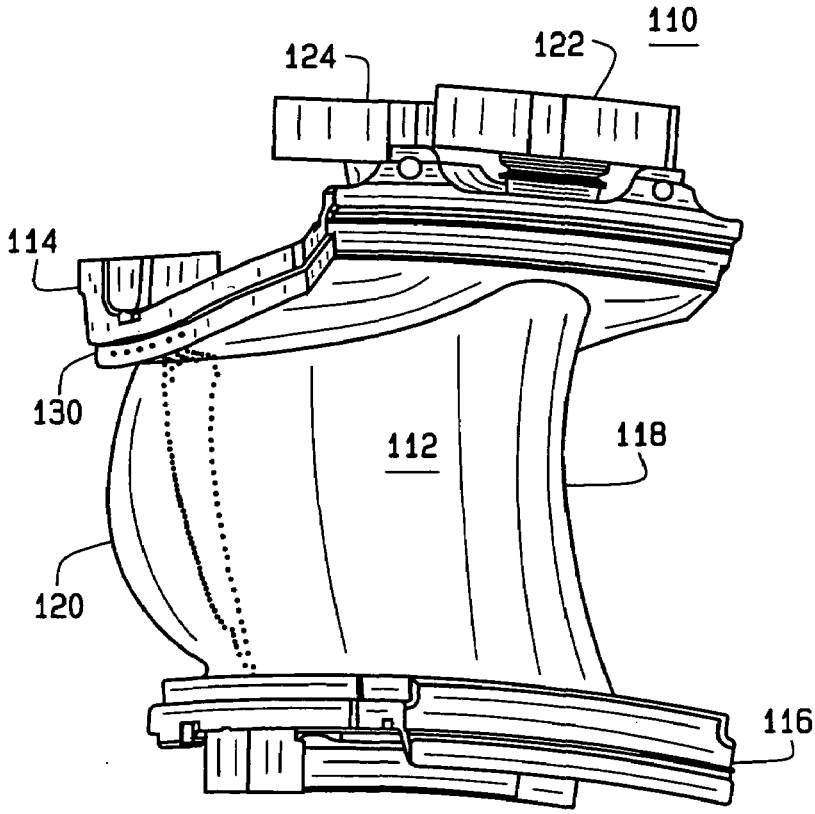
FIGS. 8A is an orthographic view of the concave side of a second embodiment of a first stage nozzle for a gas turbine.
Figure 8B:
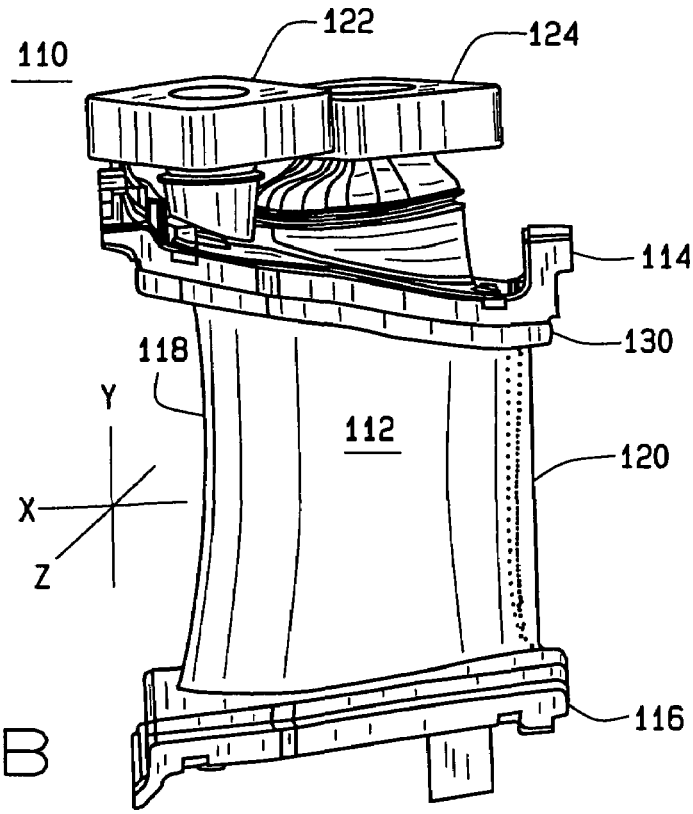
FIG. 8B is an orthographic view of the nozzle from the convex side.

With respect to FIGS. 1A and 1B, a nozzle assembly includes an outer band 14 and an inner band 16 between which airfoil 12 is mounted. Each assembly is supported within a shell (not shown) of the turbine in which turbine components are installed. Referring to FIG. 3, airfoil 12 is shown to a have a curved airfoil shape with a rounded leading edge 18 and a trailing edge 20. A steam inlet manifold 22 and a steam outlet manifold 24 are mounted on outer band 14 to circulate steam through the airfoil. Referring to FIG. 2, airfoil 12 is constructed as is generally known in the art with a series of internal flow passages indicated generally P for steam to circulate through the airfoil from inlet manifold 22 to outlet manifold 24. These flow paths will not be described in detail. In addition to circulating steam through airfoil 12, the present invention includes an air inlet 26 in outer band 14 and a plurality of air outlet holes or slots 28 for thin film cooling of the trailing edge of the airfoil. As described hereinafter, these openings are arranged in a predetermined pattern to maximize the thin film cooling of airfoil 12. The openings are formed in the sidewalls of the airfoil on both the concave side and convex side of the airfoil. The size of each opening and its location are determined in accordance with the present invention. As shown in FIGS. 5 and 7, at the outer end of the airfoil adjacent band 14, the sidewalls of the airfoil curve or flare outwardly. In addition, the airfoil has a circumferentially extending rail 30. The holes or openings are formed in this portion of the nozzle assembly as well to provide sufficient thin film cooling at the trailing edge of the airfoil.

Figure 4:
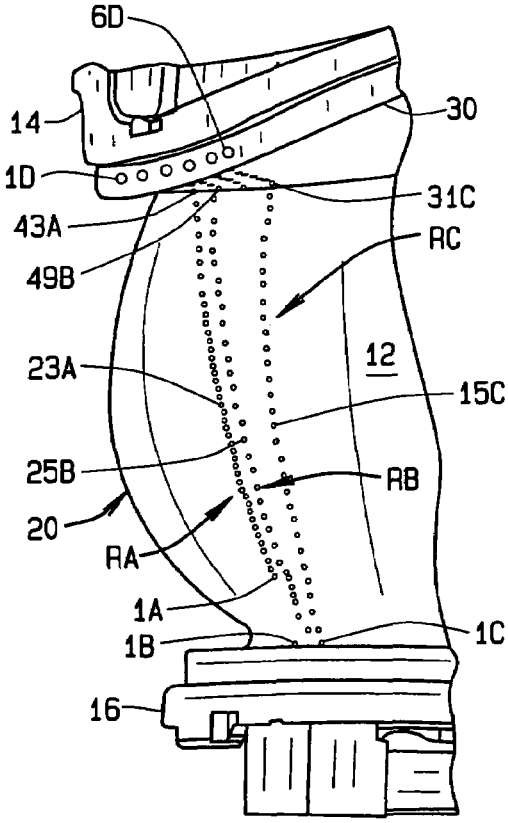
FIG. 4 is a detail view of the airfoil illustrating a film hole pattern formed in the concave side of the airfoil.
Figure 6:
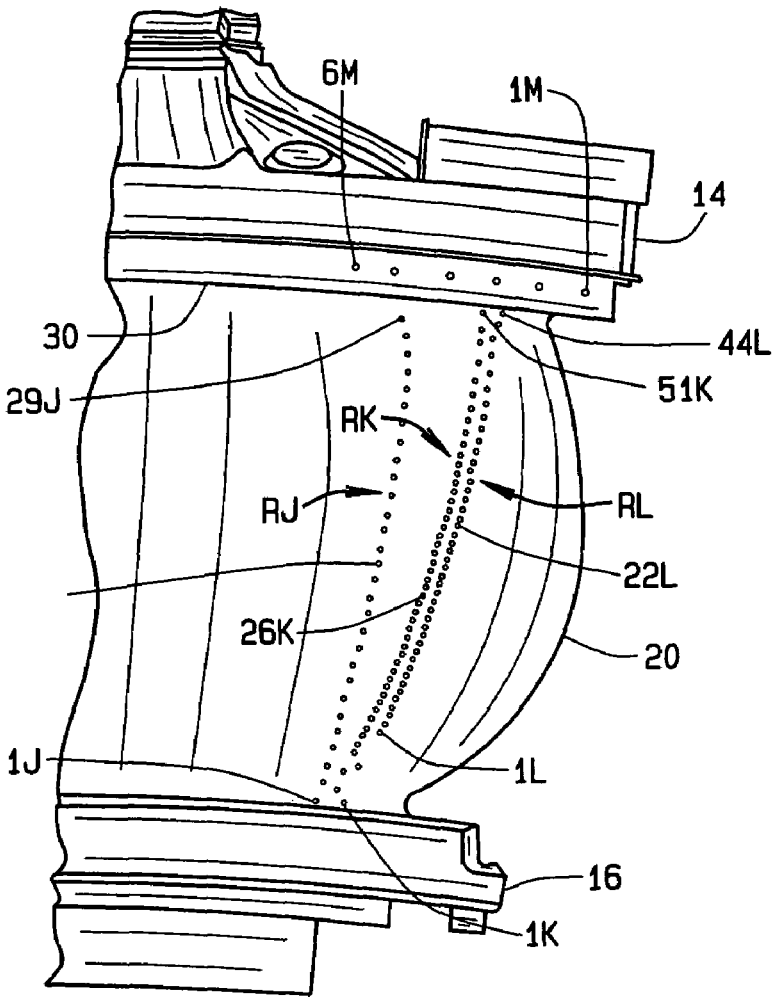
FIGS. 6 and 7 are views similar to those of FIGS. 4 and 5, respectively, for the convex side of the airfoil.

The hole pattern or arrangement of the present invention comprises three rows of openings which extend longitudinally of the airfoil, on both the concave and convex sides of the nozzle assembly, and spaced inwardly of the trailing edge. As particularly shown in FIG. 4, on the concave side of the airfoil are three rows indicated generally RA, RB, and RC, and on the convex side of the airfoil, as shown in FIG. 6, are three rows indicated RJ, RK, and RL. To further provide adequate thin film cooling of trailing edge 20, additional holes or slots are also formed in the curved portions of the airfoil adjacent outer band 14, and on the portion of rail 30 adjacent the trailing edge of the airfoil. On the concave side of the nozzle assembly, and as shown in FIGS. 4 and. 5, these additional openings are indicated 1D–6D, 1E, 1F–4F, 1G–5G, and 1H–6H. On the convex side of the assembly, and as shown in FIGS. 6 and 7, these additional openings are indicated 1M–6M, 1N–7N, 1P–4P, and 1R.

Referring again to FIGS. 4 and 6, the rows of holes or openings formed in the respective sidewalls of the airfoil include a forward row (the row furthest away from the trailing edge), an aft row (the row closest to the trailing edge), and an intermediate row. On the concave side of the assembly, row RC is the forward row and includes 51 openings. Row RB is the intermediate row and comprises 49 openings. The aft row is row RA which includes 43 openings. In accordance with the invention, the spacing between intermediate row RB and aft row RA is substantially closer than the spacing between forward row RC and intermediate row RB. Further, the holes comprising intermediate row RB and those comprising aft row RC are arranged in a staggered pattern as shown in FIG. 4. Similarly in accordance with the invention, on the convex side of the assembly, the spacing between intermediate row RK (which has 51 openings) and aft row RL (which has 44 openings) is substantially closer than the spacing between forward row RJ (which has 29 openings) and intermediate row RK. Again, the holes comprising intermediate row RK and those comprising aft row RL are arranged in a staggered pattern as shown in FIG. 6.

Table 1 is a listing of all the holes comprising rows RA–RC, RJ–RL, and the other holes formed in the bands 14 and 16 and rail 30. The table includes each hole designation, the angle of the opening with respect to the outer surface of airfoil 12, and the X, Y, Z coordinates determining the location of the hole. The distances are measured with respect to the reference point Q (0,0,0) shown in FIG. 1B.

TABLE 1

| HOLE # | DIAMETER (in.) | ANGLE TO SURFACE (°) | X (in.) | Y (in.) | Z (in.) |
|---|---|---|---|---|---|
| 1A | 0.032 | 30 | −7.792 | −2.253 | .179 |
| 2A | 0.032 | 30 | −7.777 | −2.137 | .223 |
| 3A | 0.032 | 30 | −7.766 | −2.021 | .269 |
| 4A | 0.032 | 30 | −7.757 | −7.905 | .314 |
| 5A | 0.032 | 30 | −7.748 | −1.788 | .357 |
| 6A | 0.032 | 30 | −7.741 | −1.670 | .398 |
| 7A | 0.032 | 30 | −7.736 | −1.559 | .435 |
| 8A | 0.032 | 30 | −7.732 | −1.453 | .469 |
| 9A | 0.032 | 30 | −7.729 | −1.347 | .502 |
| 10A | 0.032 | 30 | −7.727 | −1.241 | .535 |
| 11A | 0.032 | 30 | −7.726 | −1.135 | .566 |
| 12A | 0.032 | 30 | −7.726 | −1.028 | .596 |
| 13A | 0.032 | 30 | −7.726 | −.921 | .625 |
| 14A | 0.032 | 30 | −7.728 | −.814 | .653 |
| 15A | 0.032 | 30 | −7.730 | −.706 | .680 |
| 16A | 0.032 | 30 | −7.732 | −.598 | .707 |
| 17A | 0.032 | 30 | −7.736 | −.490 | .732 |
| 18A | 0.032 | 30 | −7.740 | −.382 | .756 |
| 19A | 0.032 | 30 | −7.745 | −.274 | .780 |
| 20A | 0.032 | 30 | −7.750 | −.165 | .802 |
| 21A | 0.032 | 30 | −7.756 | −.056 | .822 |
| 22A | 0.032 | 30 | −7.762 | .053 | .840 |
| 23A | 0.032 | 30 | −7.770 | .162 | .860 |
| 24A | 0.032 | 30 | −7.780 | .270 | .882 |
| 25A | 0.032 | 30 | −7.790 | .378 | .906 |
| 26A | 0.032 | 30 | −7.802 | .486 | .929 |
| 27A | 0.032 | 30 | −7.812 | .594 | .950 |
| 28A | 0.032 | 30 | −7.822 | .703 | .968 |
| 29A | 0.032 | 30 | −7.832 | .813 | .983 |
| 30A | 0.032 | 30 | −7.843 | .922 | .997 |
| 31A | 0.032 | 30 | −7.855 | 1.043 | 1.012 |
| 32A | 0.032 | 30 | −7.870 | 1.174 | 1.028 |
| 33A | 0.032 | 30 | −7.884 | 1.305 | 1.043 |
| 34A | 0.032 | 30 | −7.898 | 1.437 | 1.057 |
| 35A | 0.032 | 30 | −7.912 | 1.568 | 1.070 |
| 36A | 0.032 | 30 | −7.931 | 1.744 | 1.085 |
| 37A | 0.032 | 30 | −7.956 | 1.964 | 1.102 |
| 38A | 0.032 | 30 | −7.980 | 2.164 | 1.114 |
| 39A | 0.032 | 30 | −8.002 | 2.345 | 1.122 |
| 40A | 0.032 | 30 | −8.031 | 2.553 | 1.130 |

TABLE 1-continued

| HOLE # | DIAMETER (in.) | ANGLE TO SURFACE (°) | X (in.) | Y (in.) | Z (in.) |
|---|---|---|---|---|---|
| 41A | 0.032 | 30 | −8.060 | 2.762 | 1.128 |
| 42A | 0.032 | 30 | −8.091 | 2.969 | 1.136 |
| 43A | 0.032 | 30 | −8.066 | 3.162 | 1.244 |
| 1B | 0.032 | 37 | −7.894 | −3.250 | .074 |
| 2B | 0.032 | 37 | −7.906 | −3.049 | −.202 |
| 3B | 0.032 | 30 | −7.845 | −2.827 | −.157 |
| 4B | 0.032 | 30 | −7.790 | −2.630 | −.100 |
| 5B | 0.032 | 30 | −7.779 | −2.544 | −.060 |
| 6B | 0.032 | 30 | −7.744 | −2.427 | −.055 |
| 7B | 0.032 | 30 | −7.730 | −2.311 | −.010 |
| 8B | 0.032 | 30 | −7.715 | −2.195 | .033 |
| 9B | 0.032 | 30 | −7.702 | −2.079 | .077 |
| 10B | 0.032 | 30 | −7.691 | −1.963 | .122 |
| 11B | 0.032 | 30 | −7.682 | −1.846 | .167 |
| 12B | 0.032 | 30 | −7.675 | −1.729 | .210 |
| 13B | 0.032 | 30 | −7.668 | −1.611 | .251 |
| 14B | 0.032 | 30 | −7.664 | −1.506 | .286 |
| 15B | 0.032 | 30 | −7.660 | −1.400 | .320 |
| 16B | 0.032 | 30 | −7.658 | −1.294 | .352 |
| 17B | 0.032 | 30 | −7.657 | −1.188 | .384 |
| 18B | 0.032 | 30 | −7.657 | −1.081 | .415 |
| 19B | 0.032 | 30 | −7.658 | −.974 | .445 |
| 20B | 0.032 | 30 | −7.659 | −.867 | .474 |
| 21B | 0.032 | 30 | −7.661 | −.760 | .502 |
| 22B | 0.032 | 30 | −7.664 | −.652 | .529 |
| 23B | 0.032 | 30 | −7.667 | −.544 | .555 |
| 24B | 0.032 | 30 | −7.671 | −.436 | .580 |
| 25B | 0.032 | 30 | −7.676 | −.328 | .604 |
| 26B | 0.032 | 30 | −7.682 | −.220 | .627 |
| 27B | 0.032 | 30 | −7.687 | −.111 | .648 |
| 28B | 0.032 | 30 | −7.694 | −.002 | .668 |
| 29B | 0.032 | 30 | −7.702 | .107 | .687 |
| 30B | 0.032 | 30 | −7.711 | .216 | .707 |
| 31B | 0.032 | 30 | −7.721 | .324 | .729 |
| 32B | 0.032 | 30 | −7.733 | .432 | .752 |
| 33B | 0.032 | 30 | −7.745 | .540 | .775 |
| 34B | 0.032 | 30 | −7.756 | .649 | .795 |
| 35B | 0.032 | 30 | −7.766 | .755 | .812 |
| 36B | 0.032 | 30 | −7.777 | .868 | .827 |
| 37B | 0.032 | 30 | −7.788 | .977 | .841 |
| 38B | 0.032 | 30 | −7.802 | 1.108 | .858 |
| 39B | 0.032 | 30 | −7.817 | 1.240 | .873 |
| 40B | 0.032 | 30 | −7.832 | 1.371 | .887 |
| 41B | 0.032 | 30 | −7.848 | 1.502 | .900 |
| 42B | 0.032 | 30 | −7.863 | 1.634 | .912 |
| 43B | 0.032 | 30 | −7.886 | 1.854 | .931 |
| 44B | 0.032 | 30 | −7.910 | 2.074 | .946 |
| 45B | 0.032 | 30 | −7.931 | 2.255 | .956 |
| 46B | 0.032 | 30 | −7.954 | 2.435 | .963 |
| 47B | 0.032 | 30 | −7.985 | 2.657 | .970 |
| 48B | 0.032 | 30 | −8.014 | 2.866 | .966 |
| 49B | 0.032 | 30 | −8.042 | 3.072 | 1.028 |
| 1C | 0.032 | 105 | −7.803 | −3.190 | −.429 |
| 2C | 0.032 | 150 | −7.811 | −3.013 | −.421 |
| 3C | 0.032 | 150 | −7.726 | −2.763 | −.348 |
| 4C | 0.032 | 150 | −7.674 | −2.550 | −.304 |
| 5C | 0.032 | 150 | −7.629 | −2.335 | −.267 |
| 6C | 0.032 | 150 | −7.584 | −2.121 | −.230 |
| 7C | 0.032 | 150 | −7.544 | −1.908 | −.190 |
| 8C | 0.032 | 150 | −7.514 | −1.692 | −.146 |
| 9C | 0.032 | 150 | −7.494 | −1.476 | −.098 |
| 10C | 0.032 | 150 | −7.482 | −1.260 | −.048 |
| 11C | 0.032 | 150 | −7.476 | −1.043 | −.001 |
| 12C | 0.032 | 150 | −7.470 | −.824 | .035 |
| 13C | 0.032 | 150 | −7.464 | −.604 | .062 |
| 14C | 0.032 | 150 | −7.465 | −.383 | .090 |
| 15C | 0.032 | 150 | −7.470 | −.163 | .120 |
| 16C | 0.032 | 30 | −7.481 | .068 | .148 |
| 17C | 0.032 | 30 | −7.494 | .288 | .169 |
| 18C | 0.032 | 30 | −7.508 | .508 | .186 |
| 19C | 0.032 | 30 | −7.523 | .729 | .198 |
| 20C | 0.032 | 30 | −7.539 | .950 | .209 |
| 21C | 0.032 | 30 | −7.558 | 1.170 | .220 |
| 22C | 0.032 | 30 | −7.529 | 1.391 | .230 |
| 23C | 0.032 | 30 | −7.598 | 1.612 | .234 |

TABLE 1-continued

| HOLE # | DIAMETER (in.) | ANGLE TO SURFACE (°) | X (in.) | Y (in.) | Z (in.) |
|---|---|---|---|---|---|
| 24C | 0.032 | 30 | −7.615 | 1.833 | .234 |
| 25C | 0.032 | 30 | −7.632 | 2.054 | .232 |
| 26C | 0.032 | 30 | −7.651 | 2.276 | .228 |
| 27C | 0.032 | 30 | −7.667 | 2.496 | .206 |
| 28C | 0.032 | 30 | −7.673 | 2.712 | .152 |
| 29C | 0.032 | 30 | −7.678 | 2.919 | .094 |
| 30C | 0.032 | 30 | −7.705 | 3.073 | .102 |
| 31C | 0.032 | 85 | −7.655 | 3.210 | .102 |
| 1D | 0.030 | 30 | −8.537 | 3.433 | 2.152 |
| 2D | 0.030 | 30 | −8.810 | 3.459 | 1.880 |
| 3D | 0.030 | 30 | −7.825 | 3.503 | 1.610 |
| 4D | 0.030 | 30 | −7.471 | 3.565 | 1.340 |
| 5D | 0.030 | 108 | −7.017 | 3.668 | .993 |
| 6D | 0.030 | 108 | −6.714 | 3.751 | .760 |
| 1E | 0.032 | 30 | −7.980 | 3.215 | 1.252 |
| 1F | 0.032 | 30 | −7.966 | 3.164 | .929 |
| 2F | 0.032 | 30 | −7.833 | 3.252 | .954 |
| 3F | 0.032 | 30 | −7.682 | 3.271 | 1.036 |
| 4F | 0.032 | 30 | −7.530 | 3.293 | 1.117 |
| 1G | 0.032 | 30 | −7.840 | 3.168 | .558 |
| 2G | 0.032 | 30 | −7.711 | 3.274 | .580 |
| 3G | 0.032 | 30 | −7.544 | 3.297 | .664 |
| 4G | 0.032 | 30 | −7.396 | 3.323 | .747 |
| 5G | 0.032 | 30 | −7.239 | 3.353 | .830 |
| 1H | 0.032 | 30 | −7.558 | 3.290 | .161 |
| 2H | 0.032 | 30 | −7.433 | 3.322 | .247 |
| 3H | 0.032 | 30 | −7.293 | 3.348 | .343 |
| 4H | 0.032 | 30 | −7.153 | 3.376 | .439 |
| 5H | 0.032 | 30 | −7.013 | 3.407 | .534 |
| 6H | 0.032 | 30 | −6.874 | 3.440 | .630 |
| 1J | 0.032 | 108 | −8.349 | −3.250 | −.676 |
| 2J | 0.032 | 150 | −8.144 | −2.937 | −.568 |
| 3J | 0.032 | 150 | −8.091 | −2.727 | −.519 |
| 4J | 0.032 | 150 | −8.048 | −2.515 | −.480 |
| 5J | 0.032 | 150 | −8.014 | −2.298 | −.450 |
| 6J | 0.032 | 150 | −7.988 | −2.080 | −.424 |
| 7J | 0.032 | 150 | −7.970 | −1.861 | −.397 |
| 8J | 0.032 | 150 | −7.959 | −1.643 | −.365 |
| 9J | 0.032 | 150 | −7.956 | −1.425 | −.322 |
| 10J | 0.032 | 150 | −7.959 | −1.208 | −.276 |
| 11J | 0.032 | 150 | −7.961 | −.990 | −.240 |
| 12J | 0.032 | 150 | −7.693 | −.770 | −.216 |
| 13J | 0.032 | 150 | −7.966 | −.549 | −.193 |
| 14J | 0.032 | 150 | −7.971 | −.329 | −.166 |
| 15J | 0.032 | 150 | −7.979 | −.110 | −.137 |
| 16J | 0.032 | 30 | −7.986 | .080 | −.114 |
| 17J | 0.032 | 30 | −7.996 | .300 | −.090 |
| 18J | 0.032 | 30 | −7.005 | .521 | −.070 |
| 19J | 0.032 | 30 | −8.013 | .742 | −.054 |
| 20J | 0.032 | 30 | −8.021 | .964 | −.037 |
| 21J | 0.032 | 30 | −8.031 | 1.185 | −.018 |
| 22J | 0.032 | 30 | −8.042 | 1.406 | −.003 |
| 23J | 0.032 | 30 | −8.052 | 1.627 | .004 |
| 24J | 0.032 | 30 | −8.061 | 1.849 | .008 |
| 25J | 0.032 | 30 | −8.073 | 2.070 | .016 |
| 26J | 0.032 | 30 | −8.084 | 2.292 | .018 |
| 27J | 0.032 | 30 | −8.091 | 2.512 | −.008 |
| 28J | 0.032 | 30 | −8.093 | 2.728 | −.061 |
| 29J | 0.032 | 30 | −8.093 | 2.939 | −.123 |
| 1K | 0.032 | 30 | −8.349 | −3.250 | −.676 |
| 2K | 0.032 | 30 | −8.144 | −2.937 | −.568 |
| 3K | 0.032 | 30 | −8.091 | −2.727 | −.519 |
| 4K | 0.032 | 30 | −8.048 | −2.515 | −.480 |
| 5K | 0.032 | 30 | −8.014 | −2.298 | −.450 |
| 6K | 0.032 | 30 | −7.988 | −2.080 | −.424 |
| 7K | 0.032 | 30 | −7.970 | −1.861 | −.397 |
| 8K | 0.032 | 30 | −7.959 | −1.643 | −.365 |
| 9K | 0.032 | 30 | −8.108 | −2.206 | −.088 |
| 10K | 0.032 | 30 | −8.102 | −2.092 | −.047 |
| 11K | 0.032 | 30 | −8.097 | −1.972 | −.004 |
| 12K | 0.032 | 30 | −8.093 | −1.865 | .038 |
| 13K | 0.032 | 30 | −8.090 | −1.761 | .075 |
| 14K | 0.032 | 30 | −8.089 | −1.656 | .111 |
| 15K | 0.032 | 30 | −8.088 | −1.550 | .145 |
| 16K | 0.032 | 30 | −8.088 | −1.444 | .179 |

TABLE 1-continued

| HOLE # | DIAMETER (in.) | ANGLE TO SURFACE (°) | X (in.) | Y (in.) | Z (in.) |
|---|---|---|---|---|---|
| 17K | 0.032 | 30 | −8.089 | −1.338 | .211 |
| 18K | 0.032 | 30 | −8.091 | −1.232 | .243 |
| 19K | 0.032 | 30 | −8.094 | −1.125 | .273 |
| 20K | 0.032 | 30 | −8.096 | −1.018 | .303 |
| 21K | 0.032 | 30 | −8.100 | −.911 | .332 |
| 22K | 0.032 | 30 | −8.103 | −.804 | .359 |
| 23K | 0.032 | 30 | −8.106 | −.696 | .386 |
| 24K | 0.032 | 30 | −8.110 | −.588 | .412 |
| 25K | 0.032 | 30 | −8.114 | −.480 | .437 |
| 26K | 0.032 | 30 | −8.118 | −.372 | .462 |
| 27K | 0.032 | 30 | −8.123 | −.264 | .486 |
| 28K | 0.032 | 30 | −8.128 | −.155 | .508 |
| 29K | 0.032 | 30 | −8.132 | −.046 | .528 |
| 30K | 0.032 | 30 | −8.137 | .063 | .548 |
| 31K | 0.032 | 30 | −8.142 | .172 | .568 |
| 32K | 0.032 | 30 | −8.147 | .281 | .591 |
| 33K | 0.032 | 30 | −8.153 | .389 | .615 |
| 34K | 0.032 | 30 | −8.160 | .497 | .640 |
| 35K | 0.032 | 30 | −8.167 | .605 | .663 |
| 36K | 0.032 | 30 | −8.174 | .714 | .682 |
| 37K | 0.032 | 30 | −8.181 | .834 | .700 |
| 38K | 0.032 | 30 | −8.188 | .953 | .717 |
| 39K | 0.032 | 30 | −8.196 | 1.073 | .734 |
| 40K | 0.032 | 30 | −8.203 | 1.192 | .750 |
| 41K | 0.032 | 30 | −8.211 | 1.312 | .764 |
| 42K | 0.032 | 30 | −8.219 | 1.432 | .779 |
| 43K | 0.032 | 30 | −8.229 | 1.585 | .796 |
| 44K | 0.032 | 30 | −8.239 | 1.738 | .812 |
| 45K | 0.032 | 30 | −8.250 | 1.891 | .826 |
| 46K | 0.032 | 30 | −8.262 | 2.072 | .840 |
| 47K | 0.032 | 30 | −8.276 | 2.253 | .853 |
| 48K | 0.032 | 30 | −8.294 | 2.474 | .864 |
| 49K | 0.032 | 30 | −8.312 | 2.695 | .872 |
| 50K | 0.032 | 30 | −8.328 | 2.887 | .874 |
| 51K | 0.032 | 30 | −8.376 | 3.074 | .924 |
| 1L | 0.035 | 30 | −8.164 | −2.262 | .065 |
| 2L | 0.035 | 30 | −8.156 | −2.149 | .107 |
| 3L | 0.035 | 30 | −8.149 | −2.035 | .150 |
| 4L | 0.035 | 30 | −8.144 | −1.922 | .193 |
| 5L | 0.035 | 30 | −8.140 | −1.813 | .232 |
| 6L | 0.035 | 30 | −8.137 | −1.708 | .268 |
| 7L | 0.035 | 30 | −8.135 | −1.603 | .302 |
| 8L | 0.035 | 30 | −8.133 | −1.498 | .336 |
| 9L | 0.035 | 30 | −8.133 | −1.392 | .369 |
| 10L | 0.035 | 30 | −8.134 | −1.285 | .400 |
| 11L | 0.035 | 30 | −8.136 | −1.179 | .431 |
| 12L | 0.035 | 30 | −8.138 | −1.072 | .461 |
| 13L | 0.035 | 30 | −8.140 | −.965 | .490 |
| 14L | 0.037 | 30 | −8.143 | −.857 | .518 |
| 15L | 0.037 | 30 | −8.146 | −.750 | .545 |
| 16L | 0.037 | 30 | −8.149 | −.642 | .572 |
| 17L | 0.037 | 30 | −8.153 | −.534 | .597 |
| 18L | 0.037 | 30 | −8.157 | −.426 | .622 |
| 19L | 0.037 | 30 | −8.161 | −.318 | .646 |
| 20L | 0.037 | 30 | −8.165 | −.209 | .668 |
| 21L | 0.037 | 30 | −8.170 | −.100 | .689 |
| 22L | 0.037 | 30 | −8.174 | .008 | .709 |
| 23L | 0.037 | 30 | −8.179 | .118 | .729 |
| 24L | 0.037 | 30 | −8.184 | .226 | .751 |
| 25L | 0.037 | 30 | −8.190 | .335 | .776 |
| 26L | 0.037 | 30 | −8.197 | .443 | .801 |
| 27L | 0.035 | 30 | −8.204 | .551 | .824 |
| 28L | 0.035 | 30 | −8.211 | .660 | .844 |
| 29L | 0.035 | 30 | −8.217 | .774 | .862 |
| 30L | 0.035 | 30 | −8.224 | .893 | .879 |
| 31L | 0.035 | 30 | −8.231 | 1.013 | .895 |
| 32L | 0.035 | 30 | −8.238 | 1.133 | .912 |
| 33L | 0.035 | 30 | −8.246 | 1.252 | .928 |
| 34L | 0.035 | 30 | −8.253 | 1.372 | .942 |
| 35L | 0.035 | 30 | −8.262 | 1.509 | .958 |
| 36L | 0.035 | 30 | −8.272 | 1.661 | .974 |
| 37L | 0.035 | 30 | −8.283 | 1.814 | .988 |
| 38L | 0.032 | 30 | −8.294 | 1.981 | 1.002 |
| 39L | 0.032 | 30 | −8.308 | 2.162 | 1.015 |
| 40L | 0.032 | 30 | −8.324 | 2.363 | 1.027 |

TABLE 1-continued

| HOLE # | DIAMETER (in.) | ANGLE TO SURFACE (°) | X (in.) | Y (in.) | Z (in.) |
|---|---|---|---|---|---|
| 41L | 0.032 | 30 | −8.343 | 2.584 | 1.040 |
| 42L | 0.032 | 30 | −8.360 | 2.793 | 1.038 |
| 43L | 0.032 | 30 | −8.380 | 2.983 | 1.053 |
| 44L | 0.032 | 30 | −8.476 | 3.146 | 1.096 |
| 1M | 0.030 | 30 | −8.964 | 3.524 | −.771 |
| 2M | 0.030 | 30 | −8.964 | 3.529 | −.264 |
| 3M | 0.030 | 30 | −8.964 | 3.528 | .436 |
| 4M | 0.030 | 30 | −8.964 | 3.520 | 1.003 |
| 5M | 0.030 | 125 | −8.964 | 3.505 | 1.570 |
| 6M | 0.030 | 125 | −8.964 | 3.484 | 2.136 |
| 1N | 0.032 | 30 | −8.724 | 3.208 | −.624 |
| 2N | 0.032 | 30 | −8.625 | 3.208 | −.558 |
| 3N | 0.032 | 30 | −8.526 | 3.210 | −.492 |
| 4N | 0.032 | 30 | −8.428 | 3.213 | −.426 |
| 5N | 0.032 | 30 | −8.329 | 3.218 | −.360 |
| 6N | 0.032 | 30 | −8.246 | 3.210 | −.304 |
| 7N | 0.032 | 74 | −8.154 | 3.166 | −.247 |
| 1P | 0.032 | 30 | −8.656 | 3.211 | .072 |
| 2P | 0.032 | 30 | −8.572 | 3.211 | .119 |
| 3P | 0.032 | 30 | −8.487 | 3.213 | .164 |
| 4P | 0.032 | 30 | −8.402 | 3.215 | .210 |
| 1R | 0.032 | 30 | −8.632 | 3.204 | .878 |

Figure 9:
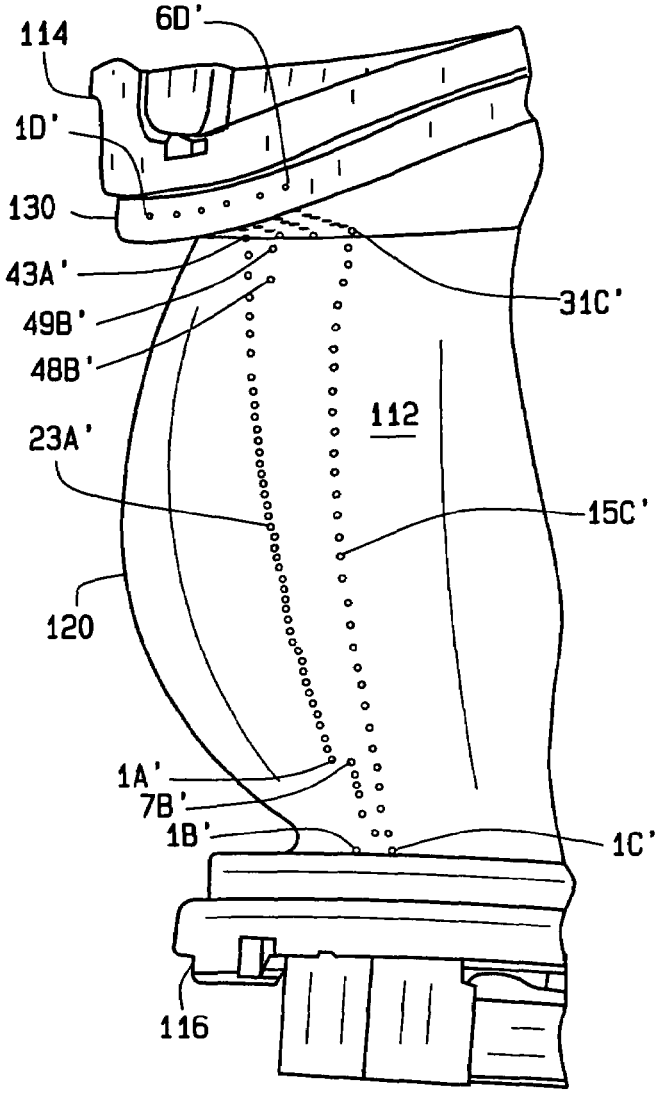
FIG. 9 is a detail view of the airfoil illustrating a film hole pattern formed in the concave side of the airfoil.
Figure 10:
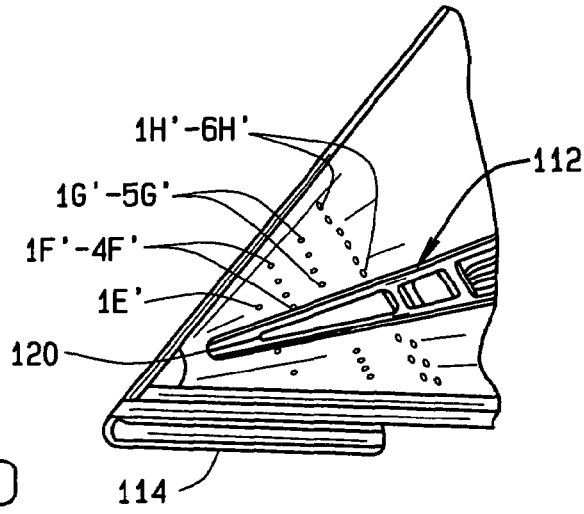
FIG. 10 is a view of the flow path side of the outer band at the trailing edge further illustrating the film hole pattern in the concave side of the airfoil; and, FIGS. 11 and 12 are views similar to those of FIGS. 9 and 10, respectively, for the convex side of the airfoil.
Figure 11:
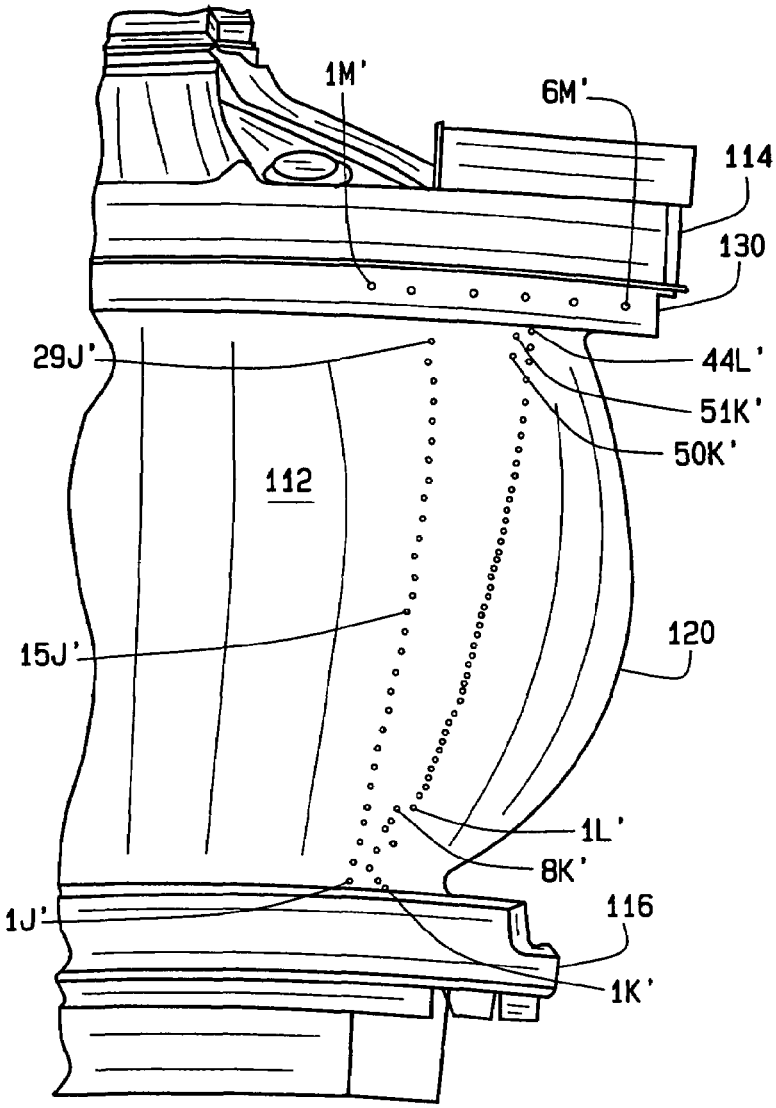
Figure 12:
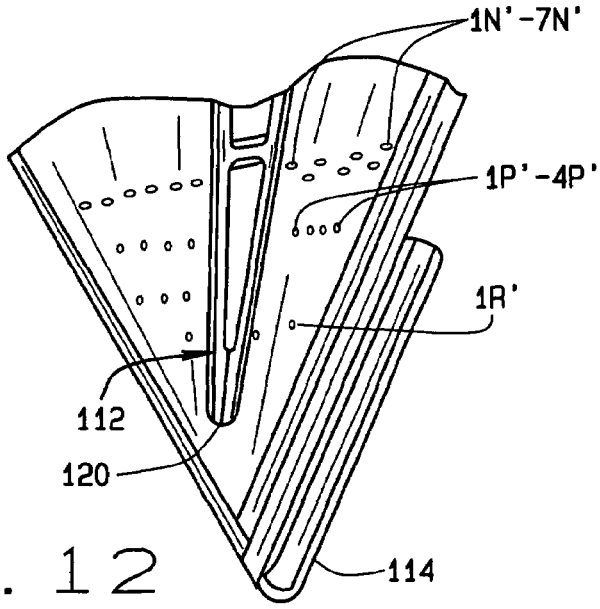

In FIGS. 8A–12, a second embodiment of a nozzle assembly of the present invention is indicated generally 110. This nozzle assembly includes an outer band 114 and an inner band 116 between which an airfoil 112 is mounted. Again, airfoil 112 has a curved airfoil shape with a rounded leading edge 118 and a trailing edge 120. Steam inlet manifold 122 and steam outlet manifold 124 are mounted on outer band 114 to circulate air through the airfoil, and an air inlet 126 admits air into the airfoil for discharge through holes or openings 128 for thin film cooling of the trailing edge of the airfoil. As with the previously described embodiment, the openings are formed in both the concave side and convex side of the airfoil in a predetermined pattern to maximize thin film cooling. The size of each opening and its location are again determined in accordance with the present invention. As shown in FIGS. 10 and 12, at the trailing edge of the airfoil, adjacent band 114, the sidewalls of the airfoil curve or flare outwardly to a circumferentially extending rail 130, and holes or openings are formed in this portion of the nozzle assembly.

The hole pattern for this embodiment again comprises three rows of openings which extend longitudinally of the airfoil, on both the concave and convex sides of the nozzle assembly, and spaced inwardly of the trailing edge. As particularly shown in FIG. 9, on the concave side of the airfoil are three rows indicated generally RA', RB', and RC', and on the convex side of the airfoil, as shown in FIG. 11, are three rows indicated RJ', RK', and RL'. To further provide adequate thin film cooling, additional holes or slots are formed in the curved portions of the airfoil adjacent outer band 114, and on the portion of rail 30 adjacent the trailing edge of the airfoil. On the concave side of the nozzle assembly, and as shown in FIGS. 9 and 10, these additional openings are indicated 1D'–6D', 1E', 1F'–4F', 1G'–5G', and 1H'–6H'. On the convex side of the assembly, and as shown in FIGS. 11 and 12, these additional openings are indicated 1M'–6M', 1N'–7N', 1P'–4P', and 1R'.

As shown in FIGS. 9 and 11, the rows of holes in the respective sidewalls of the airfoil include a forward row, an intermediate row, and an aft row. On the concave side of the assembly, row RC' is the forward row and includes 31 openings. Row RB' is the intermediate row and comprises 9 openings. The aft row is row RA' and includes 43 openings. As previously described, the spacing between intermediate row RB' and aft row RA' is substantially closer than the spacing between forward row RC' and intermediate row RB'. Further, the holes comprising intermediate row RB' and those comprising forward row RC' are arranged in a staggered pattern as shown in FIG. 9. On the convex side of the assembly, the spacing between intermediate row RK' which has 10 openings, and aft row RL' which has 44 openings, is substantially closer than the spacing between forward row RJ' which has 29 openings, and intermediate row RK'. Again, the holes comprising intermediate row RK' and those comprising aft row RL' are arranged in a staggered pattern as shown in FIG. 11.

Table 2 is a listing of all the holes comprising rows RA'–RC', RJ'–RL', and the other holes formed in the curved outer portion of the airfoil and rai 130. The table includes each hole designation, the angle of the opening with respect to the outer surface of airfoil 112, and the X,Y,Z coordinates of the hole locations. As with FIGS. 1A and 1B, the distances are measured with respect to the reference point Q (0,0,0) shown in FIG. 8B.

TABLE 2

| HOLE # | DIAMETER | ANGLE TO SURFACE | X (AB) | Y (AA) | Z (AC) |
|---|---|---|---|---|---|
| 1A | .027 | 30 | −7.792 | −2.253 | .179 |
| 2A | .027 | 30 | −7.777 | −2.137 | .223 |
| 3A | .027 | 30 | −7.766 | −2.021 | .269 |
| 4A | .027 | 30 | −7.757 | −7.905 | .314 |
| 5A | .027 | 30 | −7.748 | −1.788 | .357 |
| 6A | .027 | 30 | −7.741 | −1.670 | .398 |
| 7A | .027 | 30 | −7.736 | −1.559 | .435 |
| 8A | .027 | 30 | −7.732 | −1.453 | .469 |
| 9A | .027 | 30 | −7.729 | −1.347 | .502 |
| 10A | .027 | 30 | −7.727 | −1.241 | .535 |
| 11A | .027 | 30 | −7.726 | −1.135 | .566 |
| 12A | .027 | 30 | −7.726 | −1.028 | .596 |
| 13A | .027 | 30 | −7.726 | −.921 | .625 |
| 14A | .027 | 30 | −7.728 | −.814 | .653 |
| 15A | .027 | 30 | −7.730 | −.706 | .680 |
| 16A | .027 | 30 | −7.732 | −.598 | .707 |
| 17A | .027 | 30 | −7.736 | −.490 | .732 |
| 18A | .027 | 30 | −7.740 | −.382 | .756 |
| 19A | .027 | 30 | −7.745 | −.274 | .780 |
| 20A | .027 | 30 | −7.750 | −.165 | .802 |
| 21A | .027 | 30 | −7.756 | −.056 | .822 |
| 22A | .027 | 30 | −7.762 | .053 | .840 |
| 23A | .027 | 30 | −7.770 | .162 | .860 |
| 24A | .027 | 30 | −7.780 | .270 | .882 |
| 25A | .027 | 30 | −7.790 | .378 | .906 |
| 26A | .027 | 30 | −7.802 | .486 | .929 |
| 27A | .027 | 30 | −7.812 | .594 | .950 |
| 28A | .027 | 30 | −7.822 | .703 | .968 |
| 29A | .027 | 30 | −7.832 | .813 | .983 |
| 30A | .027 | 30 | −7.843 | .922 | .997 |
| 31A | .027 | 30 | −7.855 | 1.043 | 1.012 |
| 32A | .027 | 30 | −7.870 | 1.174 | 1.028 |
| 33A | .027 | 30 | −7.884 | 1.305 | 1.043 |
| 34A | .027 | 30 | −7.898 | 1.437 | 1.057 |
| 35A | .027 | 30 | −7.912 | 1.568 | 1.070 |
| 36A | .027 | 30 | −7.931 | 1.744 | 1.085 |
| 37A | .027 | 30 | −7.956 | 1.964 | 1.102 |
| 38A | .027 | 30 | −7.980 | 2.164 | 1.114 |
| 39A | .027 | 30 | −8.002 | 2.345 | 1.122 |
| 40A | .027 | 30 | −8.031 | 2.553 | 1.130 |
| 41A | .027 | 30 | −8.060 | 2.762 | 1.128 |
| 42A | .027 | 30 | −8.091 | 2.969 | 1.136 |
| 43A | .027 | 30 | −8.066 | 3.162 | 1.244 |
| 1B | .027 | 37 | −7.894 | −3.250 | .074 |
| 2B | .027 | 37 | −7.906 | −3.049 | −.202 |
| 3B | .027 | 30 | −7.845 | −2.827 | −.157 |
| 4B | .027 | 30 | −7.790 | −2.630 | −.100 |

TABLE 2-continued

| HOLE # | DIAMETER | ANGLE TO SURFACE | X (AB) | Y (AA) | Z (AC) |
|---|---|---|---|---|---|
| 5B | .027 | 30 | −7.779 | −2.544 | −.060 |
| 6B | .027 | 30 | −7.744 | −2.427 | −.055 |
| 7B | .027 | 30 | −7.730 | −2.311 | −.010 |
| 48B | .027 | 30 | −8.014 | 2.866 | .966 |
| 49B | .027 | 30 | −8.042 | 3.072 | 1.028 |
| 1C | .029 | 105 | −7.803 | −3.190 | −.429 |
| 2C | .029 | 150 | −7.811 | −3.013 | −.421 |
| 3C | .029 | 150 | −7.726 | −2.763 | −.348 |
| 4C | .029 | 150 | −7.674 | −2.550 | −.304 |
| 5C | .029 | 150 | −7.629 | −2.335 | −.267 |
| 6C | .029 | 150 | −7.584 | −2.121 | −.230 |
| 7C | .029 | 150 | −7.544 | −1.908 | −.190 |
| 8C | .029 | 150 | −7.514 | −1.692 | −.146 |
| 9C | .029 | 150 | −7.494 | −1.476 | −.098 |
| 10C | .029 | 150 | −7.482 | −1.260 | −.048 |
| 11C | .029 | 150 | −7.476 | −1.043 | −.001 |
| 12C | .029 | 150 | −7.470 | −.824 | .035 |
| 13C | .029 | 150 | −7.464 | −.604 | .062 |
| 14C | .029 | 150 | −7.465 | −.383 | .090 |
| 15C | .029 | 150 | −7.470 | −.163 | .120 |
| 16C | .029 | 30 | −7.481 | .068 | .148 |
| 17C | .029 | 30 | −7.494 | .288 | .169 |
| 18C | .029 | 30 | −7.508 | .508 | .186 |
| 19C | .029 | 30 | −7.523 | .729 | .198 |
| 20C | .029 | 30 | −7.539 | .950 | .209 |
| 21C | .029 | 30 | −7.558 | 1.170 | .220 |
| 22C | .029 | 30 | −7.529 | 1.391 | .230 |
| 23C | .029 | 30 | −7.598 | 1.612 | .234 |
| 24C | .029 | 30 | −7.615 | 1.833 | .234 |
| 25C | .029 | 30 | −7.632 | 2.054 | .232 |
| 26C | .029 | 30 | −7.651 | 2.276 | .228 |
| 27C | .029 | 30 | −7.667 | 2.496 | .206 |
| 28C | .029 | 30 | −7.673 | 2.712 | .152 |
| 29C | .029 | 30 | −7.678 | 2.919 | .094 |
| 30C | .029 | 30 | −7.705 | 3.073 | .102 |
| 31C | .029 | 85 | −7.655 | 3.210 | .102 |
| 1D | .030 | 30 | −8.537 | 3.433 | 2.152 |
| 2D | .030 | 30 | −8.810 | 3.459 | 1.880 |
| 3D | .030 | 30 | −7.825 | 3.503 | 1.610 |
| 4D | .030 | 30 | −7.471 | 3.565 | 1.340 |
| 5D | .030 | 108 | −7.017 | 3.668 | .993 |
| 6D | .030 | 108 | −6.714 | 3.751 | .760 |
| 1E | .032 | 30 | −7.966 | 3.215 | 1.252 |
| 1F | .032 | 30 | −7.966 | 3.164 | .929 |
| 2F | .032 | 30 | −7.833 | 3.252 | .954 |
| 3F | .032 | 30 | −7.682 | 3.271 | 1.036 |
| 4F | .032 | 30 | −7.530 | 3.293 | 1.117 |
| 1G | .032 | 30 | −7.840 | 3.168 | .558 |
| 2G | .032 | 30 | −7.711 | 3.274 | .580 |
| 3G | .032 | 30 | −7.544 | 3.297 | .664 |
| 4G | .032 | 30 | −7.396 | 3.323 | .747 |
| 5G | .032 | 30 | −7.239 | 3.353 | .830 |
| 1H | .032 | 30 | −7.558 | 3.290 | .161 |
| 2H | .032 | 30 | −7.433 | 3.322 | .247 |
| 3H | .032 | 30 | −7.293 | 3.348 | .343 |
| 4H | .032 | 30 | −7.153 | 3.376 | .439 |
| 5H | .032 | 30 | −7.013 | 3.407 | .534 |
| 6H | .032 | 30 | −6.874 | 3.440 | .630 |
| 1J | .028 | 108 | −8.349 | −3.250 | −.676 |
| 2J | .028 | 150 | −8.144 | −2.937 | −.568 |
| 3J | .028 | 150 | −8.091 | −2.727 | −.519 |
| 4J | .028 | 150 | −8.048 | −2.515 | −.480 |
| 5J | .028 | 150 | −8.014 | −2.298 | −.450 |
| 6J | .028 | 150 | −7.988 | −2.080 | −.424 |
| 7J | .028 | 150 | −7.970 | −1.861 | −.397 |
| 8J | .028 | 150 | −7.959 | −1.643 | −.365 |
| 9J | .028 | 150 | −7.956 | −1.425 | −.322 |
| 10J | .028 | 150 | −7.959 | −1.208 | −.276 |
| 11J | .028 | 150 | −7.961 | −.990 | −.240 |
| 12J | .028 | 150 | −7.693 | −.770 | −.216 |
| 13J | .028 | 150 | −7.966 | −.549 | −.193 |
| 14J | .028 | 150 | −7.971 | −.329 | −.166 |
| 15J | .028 | 150 | −7.979 | −.110 | −.137 |
| 16J | .028 | 30 | −7.986 | .080 | −.114 |
| 17J | .028 | 30 | −7.996 | .300 | −.090 |

TABLE 2-continued

| HOLE # | DIAMETER | ANGLE TO SURFACE | X (AB) | Y (AA) | Z (AC) |
|---|---|---|---|---|---|
| 18J | .028 | 30 | −7.005 | .521 | −.070 |
| 19J | .028 | 30 | −8.013 | .742 | −.054 |
| 20J | .028 | 30 | −8.021 | .964 | −.037 |
| 21J | .028 | 30 | −8.031 | 1.185 | −.018 |
| 22J | .028 | 30 | −8.042 | 1.406 | −.003 |
| 23J | .028 | 30 | −8.052 | 1.627 | .004 |
| 24J | .028 | 30 | −8.061 | 1.849 | .008 |
| 25J | .028 | 30 | −8.073 | 2.070 | .016 |
| 26J | .028 | 30 | −8.084 | 2.292 | .018 |
| 27J | .028 | 30 | −8.091 | 2.512 | −.008 |
| 28J | .028 | 30 | −8.093 | 2.728 | −.061 |
| 29J | .028 | 30 | −8.093 | 2.939 | −.123 |
| 1K | .028 | 30 | −8.349 | −3.250 | −.676 |
| 2K | .028 | 30 | −8.144 | −2.937 | −.568 |
| 3K | .028 | 30 | −8.091 | −2.727 | −.519 |
| 4K | .028 | 30 | −8.048 | −2.515 | −.480 |
| 5K | .028 | 30 | −8.014 | −2.298 | −.450 |
| 6K | .028 | 30 | −7.988 | −2.080 | −.424 |
| 7K | .028 | 30 | −7.970 | −1.861 | −.397 |
| 8K | .028 | 30 | −7.959 | −1.643 | −.365 |
| 50K | .027 | 30 | −8.328 | 2.887 | .874 |
| 51K | .027 | 30 | −8.376 | 3.074 | .924 |
| 1L | .029 | 30 | −8.164 | −2.262 | .065 |
| 2L | .029 | 30 | −8.156 | −2.149 | .107 |
| 3L | .029 | 30 | −8.149 | −2.035 | .150 |
| 4L | .029 | 30 | −8.144 | −1.922 | .193 |
| 5L | .029 | 30 | −8.140 | −1.813 | .232 |
| 6L | .029 | 30 | −8.137 | −1.708 | .268 |
| 7L | .029 | 30 | −8.135 | −1.603 | .302 |
| 8L | .029 | 30 | −8.133 | −1.498 | .336 |
| 9L | .029 | 30 | −8.133 | −1.392 | .369 |
| 10L | .029 | 30 | −8.134 | −1.285 | .400 |
| 11L | .029 | 30 | −8.136 | −1.179 | .431 |
| 12L | .029 | 30 | −8.138 | −1.072 | .461 |
| 13L | .029 | 30 | −8.140 | −.965 | .490 |
| 14L | .030 | 30 | −8.143 | −.857 | .518 |
| 15L | .030 | 30 | −8.146 | −.750 | .545 |
| 16L | .030 | 30 | −8.149 | −.642 | .572 |
| 17L | .030 | 30 | −8.153 | −.534 | .597 |
| 18L | .030 | 30 | −8.157 | −.426 | .622 |
| 19L | .030 | 30 | −8.161 | −.318 | .646 |
| 20L | .030 | 30 | −8.165 | −.209 | .668 |
| 21L | .030 | 30 | −8.170 | −.100 | .689 |
| 22L | .030 | 30 | −8.174 | .008 | .709 |
| 23L | .030 | 30 | −8.179 | .118 | .729 |
| 24L | .030 | 30 | −8.184 | .226 | .751 |
| 25L | .030 | 30 | −8.190 | .335 | .776 |
| 26L | .030 | 30 | −8.197 | .443 | .801 |
| 27L | .029 | 30 | −8.204 | .551 | .824 |
| 28L | .029 | 30 | −8.211 | .660 | .844 |
| 29L | .029 | 30 | −8.217 | .774 | .862 |
| 30L | .029 | 30 | −8.224 | .893 | .879 |
| 31L | .029 | 30 | −8.231 | 1.013 | .895 |
| 32L | .029 | 30 | −8.238 | 1.133 | .912 |
| 33L | .029 | 30 | −8.246 | 1.252 | .928 |
| 34L | .029 | 30 | −8.253 | 1.372 | .942 |
| 35L | .029 | 30 | −8.262 | 1.509 | .958 |
| 36L | .029 | 30 | −8.272 | 1.661 | .974 |
| 37L | .029 | 30 | −8.283 | 1.814 | .988 |
| 38L | .028 | 30 | −8.294 | 1.981 | 1.002 |
| 39L | .028 | 30 | −8.308 | 2.162 | 1.015 |
| 40L | .028 | 30 | −8.324 | 2.363 | 1.027 |
| 41L | .028 | 30 | −8.343 | 2.584 | 1.040 |
| 42L | .028 | 30 | −8.360 | 2.793 | 1.038 |
| 43L | .028 | 30 | −8.380 | 2.983 | 1.053 |
| 44L | .028 | 30 | −8.476 | 3.146 | 1.096 |
| 1M | .030 | 30 | −8.964 | 3.524 | −.771 |
| 2M | .030 | 30 | −8.964 | 3.529 | −.264 |
| 3M | .030 | 30 | −8.964 | 3.528 | .436 |
| 4M | .030 | 30 | −8.964 | 3.520 | 1.003 |
| 5M | .030 | 125 | −8.964 | 3.505 | 1.570 |
| 6M | .030 | 125 | −8.964 | 3.484 | 2.136 |
| 1N | .032 | 30 | −8.724 | 3.208 | −.624 |
| 2N | .032 | 30 | −8.625 | 3.208 | −.558 |
| 3N | .032 | 30 | −8.526 | 3.210 | −.492 |

TABLE 2-continued

| HOLE # | DIAMETER | ANGLE TO SURFACE | X (AB) | Y (AA) | Z (AC) |
|---|---|---|---|---|---|
| 4N | .032 | 30 | −8.428 | 3.213 | −.426 |
| 5N | .032 | 30 | −8.329 | 3.218 | −.360 |
| 6N | .032 | 30 | −8.246 | 3.210 | −.304 |
| 7N | .032 | 74 | −8.154 | 3.166 | −.247 |
| 1P | .032 | 30 | −8.656 | 3.211 | .072 |
| 2P | .032 | 30 | −8.572 | 3.211 | .119 |
| 3P | .032 | 30 | −8.487 | 3.213 | .164 |
| 4P | .032 | 30 | −8.402 | 3.215 | .210 |
| 1R | .032 | 30 | −8.632 | 3.204 | .878 |

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A nozzle assembly for a turbine engine comprising:

an inner band and an outer band spaced apart from each other; a nozzle installed between the bands and having an inner segment and a trailing edge, the nozzle having cavities formed therein for fluid flow through the nozzle assembly;

a plurality of film cooling holes formed in a sidewall of the nozzle on a concave side thereof and a plurality of film cooling holes formed in a sidewall of the nozzle on a convex side thereof, the film cooling holes being formed on each side of the nozzle in a plurality of rows of holes including at least a forward row, an aft row, and a row intermediate the forward and aft rows, the spacing between the intermediate row and aft row being substantially closer together than the spacing between the forward row and the intermediate row; and wherein the size and location of each hole are set forth in Table 1.

2. A nozzle assembly for a turbine engine comprising:

an inner band and an outer band spaced apart from each other; a nozzle installed between the bands and having an inner segment and a trailing edge, the nozzle having cavities formed therein for fluid flow through the nozzle assembly;

a plurality of film cooling holes formed in a sidewall of the nozzle on a concave side thereof and a plurality of film cooling holes formed in a sidewall of the nozzle on a convex side thereof, the film cooling holes being formed on each side of the nozzle in a plurality of rows of holes including at least a forward row, an aft row, and a row intermediate the forward and aft rows, the spacing between the intermediate row and aft row being substantially closer together than the spacing between the forward row and the intermediate row; and wherein the size and location of each hole are set forth in Table 2.

3. In a gas turbine engine, a first stage nozzle assembly comprising:

a plurality of circumferentially arranged nozzle segments with the respective segments being connected to one another to form an annular array defining a path for hot gasses passing through the first stage;

each segment including an inner band and an outer band spaced apart from each other with an airfoil installed between the bands, the airfoil having an inner segment and a trailing edge, and cavities formed therein for fluid flow through the airfoil;

a plurality of film cooling holes formed in respective sidewalls of the airfoil on a concave side and a convex side of the airfoil, the film cooling holes being formed on each side of the airfoil, in a plurality of rows of holes including a forward row, an intermediate row, and an aft row, with the spacing between the intermediate row and the aft row being substantially closer together than the spacing between the forward row and the intermediate row; and wherein the size and location of each hole are set forth in Table 1.

4. In a gas turbine engine, a first stage nozzle assembly comprising:

a plurality of circumferentially arranged nozzle segments with the respective segments being connected to one another to form an annular array defining a path for hot gasses passing through the first stage;

each segment including an inner band and an outer band spaced apart from each other with an airfoil installed between the bands, the airfoil having an inner segment and a trailing edge, and cavities formed therein for fluid flow through the airfoil;

a plurality of film cooling holes formed in respective sidewalls of the airfoil on a concave side and a convex side of the airfoil, the film cooling holes being formed on each side of the airfoil, in a plurality of rows of holes including a forward row, an intermediate row, and an aft row, with the spacing between the intermediate row and the aft row being substantially closer together than the spacing between the forward row and the intermediate row; and wherein the size and location of each hole are set forth in Table 2.

* * * * *